United States Patent [19]

Hara et al.

[11] Patent Number: 4,690,083

[45] Date of Patent: Sep. 1, 1987

[54] AUTOMATIC UPPER THREAD TENSION CONTROL FOR A SEWING MACHINE

[75] Inventors: Kazumasa Hara; Mikio Koike, both of Tokyo; Akiyoshi Sasano, Musashino, all of Japan

[73] Assignee: Janome Sewing Machine Co. Ltd., Tokyo, Japan

[21] Appl. No.: 797,418

[22] Filed: Nov. 12, 1985

[30] Foreign Application Priority Data

Nov. 9, 1984 [JP] Japan ..... 59-236088
Nov. 20, 1984 [JP] Japan ..... 59-243253

[51] Int. Cl.[4] ..... D05B 47/04
[52] U.S. Cl. ..... 112/254
[58] Field of Search ..... 112/254, 253, 302, 255, 112/453

[56] References Cited

U.S. PATENT DOCUMENTS 4,166,423 9/1979 Brienza et al. ..... 112/254
4,215,641 8/1980 Dobrjanskyj et al. ..... 112/255 X
4,289,087 9/1981 Takenoya et al. ..... 112/254
4,301,757 11/1981 Tonomura ..... 112/254
4,377,980 3/1983 Hanyo et al. ..... 112/254
4,611,547 9/1986 Kuramoto ..... 112/254
4,616,583 10/1986 Takano et al. ..... 112/254

FOREIGN PATENT DOCUMENTS 59-49823 12/1984 Japan ..... 112/302

*Primary Examiner*—Werner H. Schroeder
*Assistant Examiner*—Andrew M. Falik
*Attorney, Agent, or Firm*—Michael J. Striker

[57] ABSTRACT

An automatic thread tension adjusting device for a sewing machine designed to automatically adjust the tension of upper thread to produce desired stitches each formed with the upper and lower threads interlocked with each other within the thickness of a fabric to be sewn, the interlocking position of the threads depending upon the types of stitches such as the straight stitches and zigzag stitches. The thread is held and drawn-out at predetermined angular positions of an upper drive shaft, which are detected by sensors to thereby draw out a required amount of upper thread depending upon the thickness of the fabric and the type of stitches. The required amount of the upper thread is supplied to a thread take-up lever to determine the upper thread tension during the formation process of each stitch.

8 Claims, 34 Drawing Figures

Ⓐ Upper thread amount supplied by take-up lever
Ⓑ Upper thread amount supplied by loop taker ⓐ Hold ⓑ Release θ →
Ⓒ Amount of moving down of cushion lever
Ⓓ Actuation of 1st stopper
Ⓔ Actuation of 2nd stopper
Ⓕ Upper thread amount supplied from 1st stopper Ⓐ Upper thread amount supplied by take-up lever
Ⓑ Upper thread amount supplied by loop taker Ⓒ Amount of moving down of cushion lever
Ⓓ Actuation of 1st stopper
Ⓔ Actuation of 2nd stopper
Ⓕ Upper thread amount supplied from 1st stopper

AUTOMATIC UPPER THREAD TENSION CONTROL FOR A SEWING MACHINE

FIELD OF THE INVENTION

The present invention relates to an automatic thread tension adusting device for a sewing machine.

BACKGROUND OF THE INVENTION

The invention relates to an automatic thread tension adjusting device of a sewing machine.

Generally, a sewing machine has an upper drive shaft rotatable to vertically reciprocate a swingable needle to penetrate a fabric to be sewn and also to reciprocate a thread take-up lever to supply an upper thread from a supply means to the needle and tighten a stitch to be formed. The sewing machine has a loop taker rotatable in association with the upper drive shaft to catch the upper thread for interlocking the upper thread with a lower thread to form the stitch, the upper thread being extended between an upper thread supply and the needle and through at least the thread take-up lever. To tension the upper threads a pair of spring biased disks frictionally clamp it. This clamping pressure is variably adjustable depending on stitch type, fabric thickness, and the type of thread being used. In same designs a computer is used to process these variables so that the clamping pressure is set at the most optimum level for a particular sewing condition. Such an arrangement is usually very complicated and lacks the flexibility to adapt to the many different sewing conditions.

Therefore, the invention is very simple in structure and very reliable in operation, and further may be produced at a lower cost.

SUMMARY OF THE INVENTION

The invention relates to a sewing machine and more particularly relates to an automatic thread tension adjusting device for a sewing machine which is designed to automatically adjust the tension of the upper thread to produce desired stitches with the upper and lower threads interlocked with each other within the thickness of a fabric to be sewn, such that the required thread interlocking position depends upon the types of stitches, such as straight stitches and zigzag stitches.

Therefore the purpose of the present invention is to realize such an automatic thread tension for a sewing machine, which is simple in structure and may supply the proper amount of the upper thread.

The problem posed by the prior art, namely, how to overcome the difficulties imposed by threads being made of various materials, is solved in the present invention by employing a pair of thread holders in place of the frictionally clamping disks. The thread holders are designed to hold and release the upper thread in a timed relation to supply to the needle and/or the fabric an amount of the upper thread just required to form stitches, while the thread take-up lever draws out a predetermined amount of the upper thread from the upper thread supply against the action of a cushion spring.

The invention is designed to supply to a needle the amount of upper thread required to form each stitch and which is variable depending on the thickness of a fabric to be sewn and depending on the types of stitches, including the straight stitches and zigzag stitches.

According to the invention, thread tension means is provided between the upper thread supply and the thread take-up lever, the thread tension means guiding said upper thread and normally giving a predetermined constant tension to said upper thread.

DETAILED DESCRIPTION OF THE PREFERRED EMBODIMENTS

Figure 25:
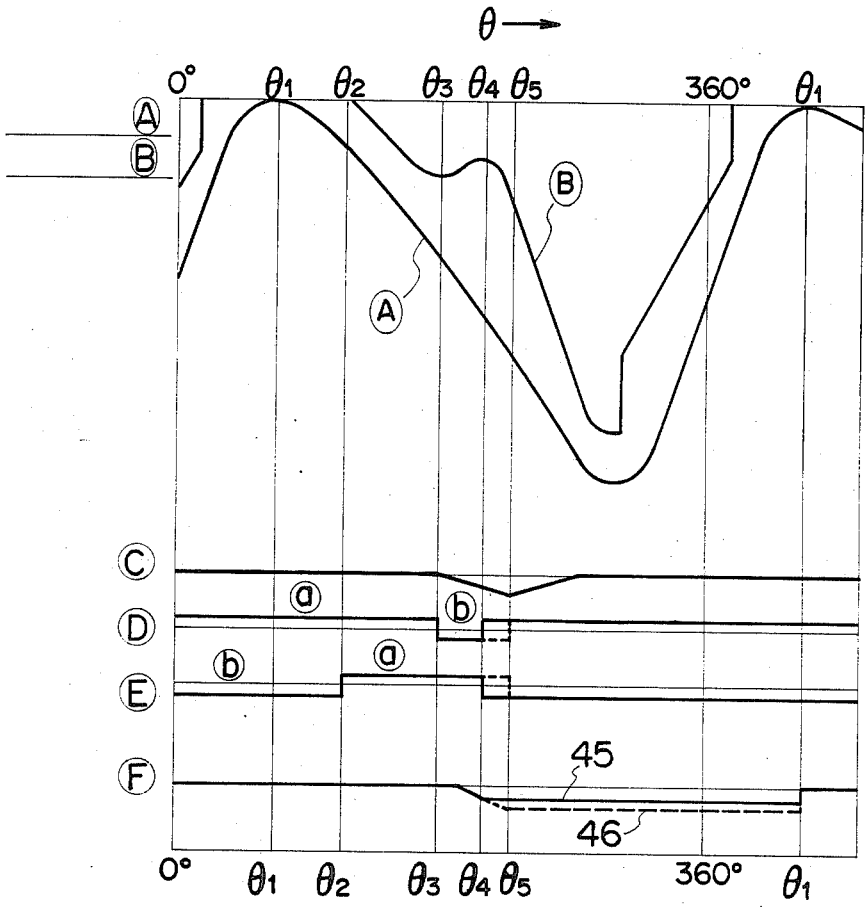
FIG. 25 is a diagram showing the timed activation of elements in connection with the amount of upper thread required to form a stitch, in reference to the predetermined angular positions of the upper drive shaft in a stitch forming cycle.
Figure 26:
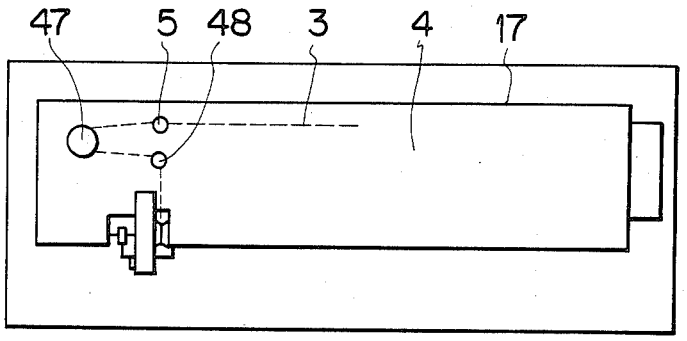
FIG. 26 is a plan view of the previously mentioned sewing machine.
Figure 27:
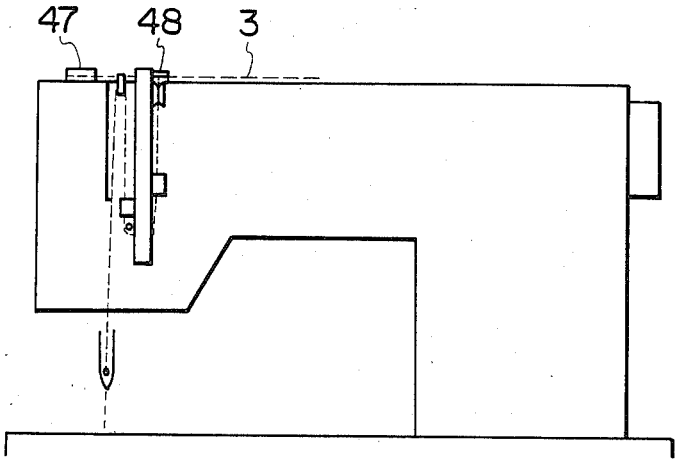
FIG. 27 is a front view of said sewing machine.

The invention is designed to utilize two characteristics to be found in the stitch forming cycle. Namely a proper amount of upper thread to be consumed for forming a stitch is closely related to a surplus or slackened amount of upper thread at a specific angular position of an upper drive shaft of the sewing machine, and this proper amount of upper thread may be detected by a spring element such as a cushion spring located in a path of the upper thread. This proper amount of upper thread may be supplied to the fabric to be sewn by the action of the spring element or by a thread draw-out means which is activated in reference to the position of the spring element. The surplus or slackened amount of upper thread is shown in FIG. 25, that is, the upper thread amount required by a loop taker may be subtracted from the upper thread amount supplied by the thread take-up lever.

The structure of the invention and principle of the action thereof will be explained with reference to FIGS. 1 to 6 of the attached drawings.

Figure 1:
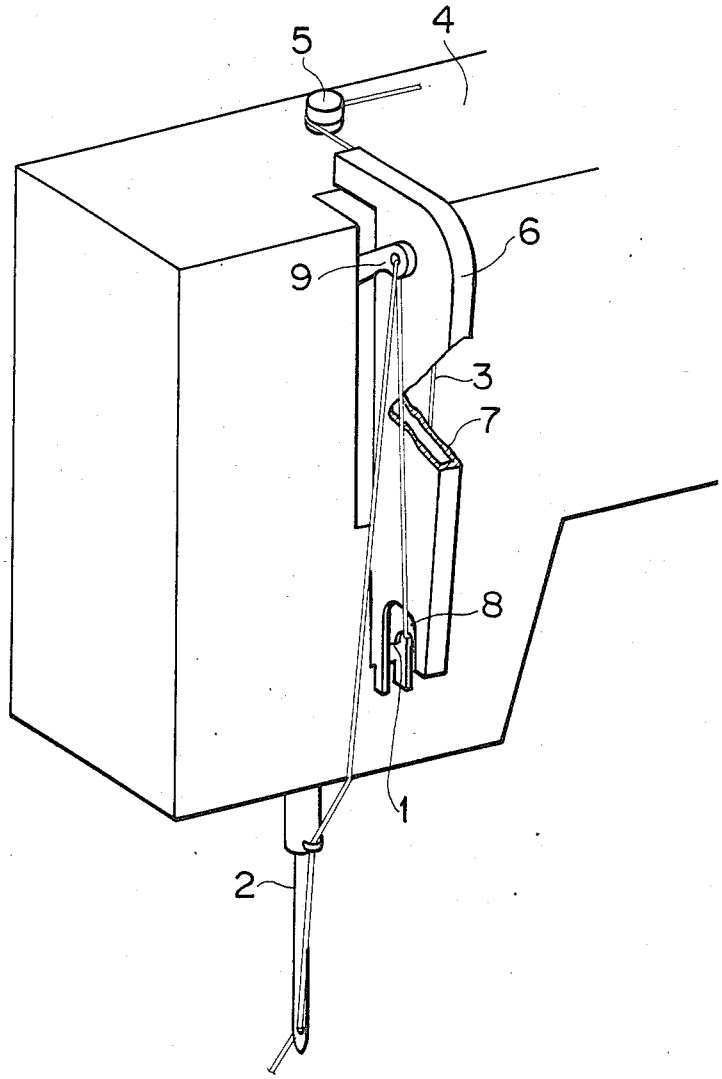
FIG. 1 is an explanatory view for a path of the upper thread of a general straight sewing machine.

FIG. 1 shows schematically the path of the upper thread 3 from the cushion spring 1 to a needle 2. The upper thread 3 passes a thread guide 5 provided on an upper part 4 of the sewing machine and a thread presser (not shown) provided at a right side 7 of a take-up cover 6, and turns at a cutout 8 of the take-up cover 6, and comes to a needle 2 via the cushion spring 1 and a take-up lever 9. The cushion spring 1 moves vertically and is normally biased downward, and the action range is restrained by a restraining member (not shown).

Figure 2:
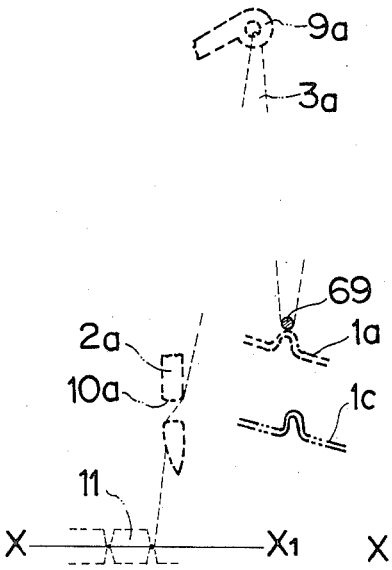
FIGS. 2 and 3 are schematic views of the relative positions of various elements during the formation of a stitch.
Figure 3:
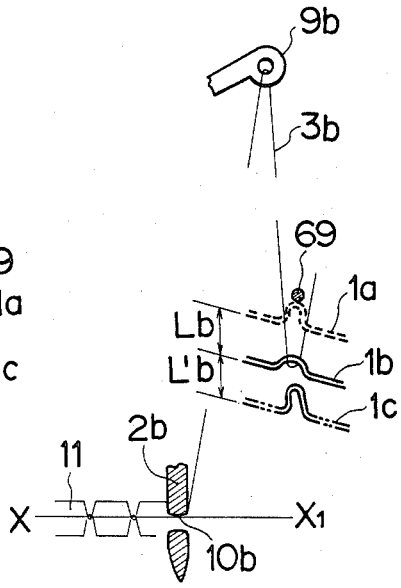

FIGS. 2 and 3 show operating conditions of the cushion spring 1. FIG. 2 shows a phase of an upper dead point of the take-up lever. FIG. 3 shows a phase where the needle 2*b* moving down comes, at an upper part 10*a* of a needle eye, to a line $X$-$X_1$, running in center of thickness of stitches in a fabric under stitching.

FIG. 3 shows the relative positions of the cushion spring 1*b*, the thread take-up lever 9*b* and the needle 2*b* in the stitch forming cycle. The relative positions of the elements may be called a reference phase of the elements which defines the proper amount of upper thread to be consumed for a stitch having the surplus or slackened upper thread interlocked with the lower thread at a desired position within the thickness of the fabric on the assumption that the surplus upper thread is defined as something from the subtraction of the upper thread amount required by the loop taker and the upper thread amount required for forming a stitch from the upper thread amount supplied by the thread take-up lever.

Since the surplus amount of the upper thread is zero in the upper dead point phase of the take-up lever, the cushion spring 1*a* is pushed up to the upper restraining member 69 as seen in FIG. 2.

Since the surplus amount of the upper thread is supplied during the relative phase shown in FIG. 3, the cushion spring 1*b* absorbs the surplus amount of the upper thread as shown in FIG. 3 and it moves down. About twice of Lb distance shown in FIG. 3 is the surplus amount of the upper thread, and the more the amount of the upper thread to be consumed for forming the stitches, the less is the surplus amount of the upper thread by the above definition. The cushion spring 1*b* is positioned at the upper part of the needle eye, while it is positioned at the lower part of the needle eye when the amount of the upper thread to be consumed is small. In the relative phase of the stitches where, for example, it is assumed that the feed amount and the fabric thickness are zero, and the consuming amount of the upper thread is zero, the cushion spring moves down to a position 1*c* shown by a dotted line. This position will be called "reference position" hereafter.

Figure 4:
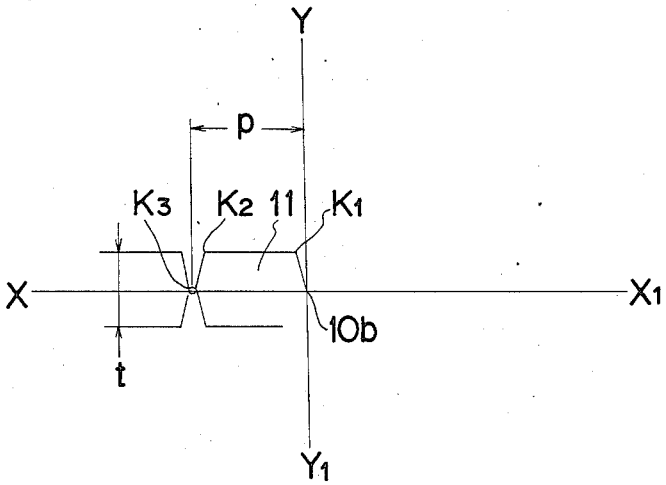
FIG. 4 is a schematic view showing the length of thread required to form a stitch in a fabric.

FIG. 4 shows schematically the amount of the upper thread to be consumed until the relative phase in the stitch forming cycle where the fabric thickness=t, and the feed amount=p. The segment $X$-$X_1$ shows the center line of the fabric thickness 11, and the segment $Y$-$Y_1$ shows a locus of the upper part 10*a* of the needle eye of the needle 2. The crossing point 10*b* of the segment $X$-$X_1$ and the segment $Y$-$Y_1$ is the upper part 10*a* of the needle eye. It is seen that the amount of the upper thread having been consumed between the preceding relative phase and the subsequent relative phase, is shown by the segment 10*b*-$K_1$-$K_2$-$K_3$ equivalent to the proper consumption amount of the upper thread to be required for forming the stitches of 1 cycle.

For convenience sake, if a stitch requires upper thread consumption, the segments 10*b*-$K_1$-$K_2$-$K_3$ will be 0 and the cushion spring 1*c* is at the bottom position as shown in FIG. 3. It will therefore be understood that the segments 10*b*-$K_1$-$K_2$-$K_3$ correspond to the upper thread amount Lb+L'b, that is, twice as much as the amount L'b when the cushion spring 1*c* comes again to the position 1*b* through the position 1*a*.

FIGS. 5 to 8 are for explaining the supply of the upper thread in accordance with the action of the above mentioned cushion spring 1.

Figure 5:
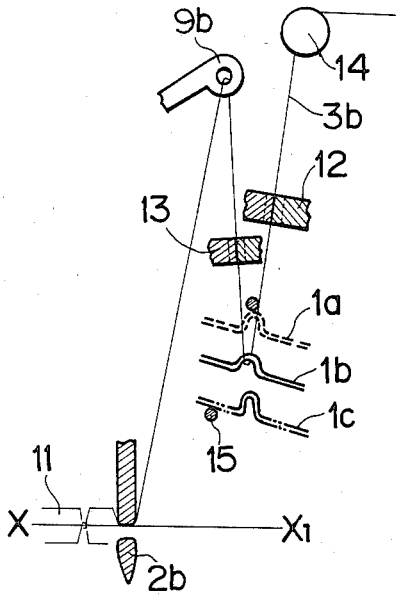
FIGS. 5 to 8 are schematic views depicting, in sequence, the relative positions of various elements, in addition to those shown in FIGS. 2 and 3, during the formation of a stitch.

In the present invention, there are, as shown in FIG. 5, provided a first stopper 12 and a second stopper 13 before and after the cushion spring 1*b* with respect to the upper thread path, which intermittenly press and hold the upper thread 3*b*.

Since the surplus amount of the upper thread is zero at the upper dead point of the take-up lever as shown in FIG. 2 and the stitching thread 3 is under tension, the cushion spring 1 is positioned at the phase 1*a* shown by the dotted line. At this time, the first stopper 12 is in operation and holds the upper thread and the second stopper 13 is released.

When the cushion spring 1 is positioned at the phase 1*b* shown by the solid line in FIG. 5, the second stopper 13 is also actuated and holds the upper thread 3*b*. Thereby, even if the thread is loosened after the relative phase and between the preceding stitch and the second stopper 13, the cushion spring 1 is continuously positioned at the phase 1*b*.

Figure 6:
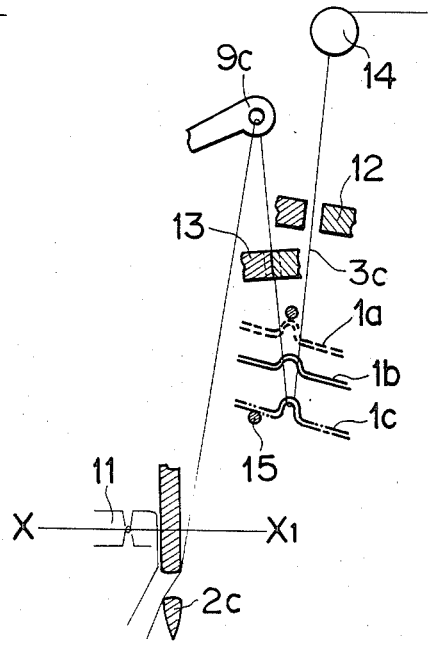
Figure 7:
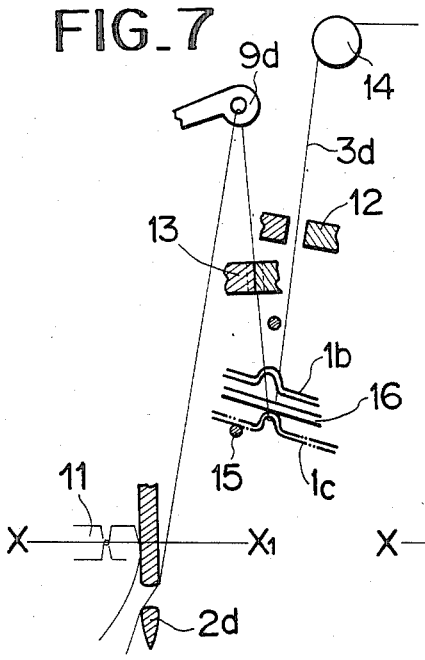
Figure 8:
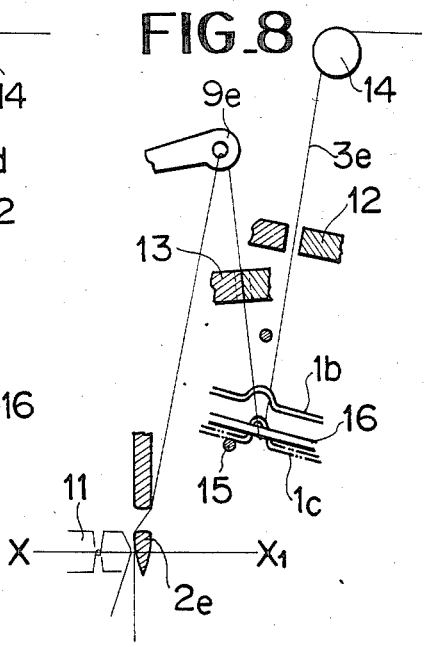

When the first stopper 12 is released as shown in FIG. 6, the upper thread 3*c* is sent to the cushion spring 1*b* via a pretension 14, only as far as the cushion spring 1*b* is stronger in strength than the pretension 14, and the cushion spring 1*b* moves down. Under this condition, if the cushion spring 1 is limited by a lower limit stopper 15 and can not move down lower than the above mentioned reference position 1*c*, the cushion spring 1*b* is stopped at the lowest phase 1*c*. The first and second stoppers 12, 13 are sequentially operated to draw out and supply to the needle the amount of upper thread required to form the stitch shown in FIG. 4, i.e. 10*b*-K1-K2-K3. On the other hand, if the cushion spring 1*b* does not have an elastic force stronger than the tension of the pretension 14, a thread drawing-out lever 16 is used as shown in FIG. 7 and is moved down to the reference position 1*c* of the cushion spring 1 in order to draw out the thread in substitution for the cushion spring. If the thread drawing-out lever 16 is further moved lower than the reference position of the cushion lever 1, a surplus supply will be possible. The surplus supply may be utilized to adjust to the proper consumption amount of the upper thread in association with changing of later mentioned stitching conditions.

The embodiment of the invention will be explained with reference to the attached drawings.

Figure 11:
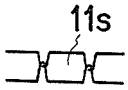
FIG. 11 is an explanatory view for proper stitches of the zig-zag stitching.
Figure 12:
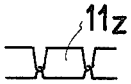
FIG. 12 is an explanatory view for proper stitches of the straight stitching.
Figure 13:
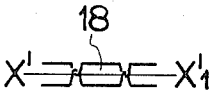
FIG. 13 is an explanatory view of required stitches to be formed in a thinner fabric.
Figure 14:
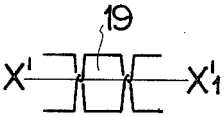
FIG. 14 is an explanatory view of required stitches to be formed in a thicker fabric.

FIGS. 9 to 25 show a first embodiment of the invention which is formed in accordance with the above mentioned principle, and incorporates mechanisms in response to each of stitching conditions. With respect to the straight stitching and the pattern stitching in the forward stitching sewing machine, as is apparent in comparison to the stitches shown in FIGS. 11 and 12, the proper thread tension of the stitches 11*z* of the pattern stitching shown in FIG. 12 is required to be larger, in the consumption amount of the upper thread, than the proper thread tension of the stitches 11*s* of the straight stitching shown in FIG. 11. The first embodiment of the invention is incorporated with such a mechanism responding to the above mentioned requirement or to the difference between the relative phase of a thin fabric 18 shown in FIG. 13 and the relative phase of a thick fabric 19 shown in FIG. 14.

Figure 9:
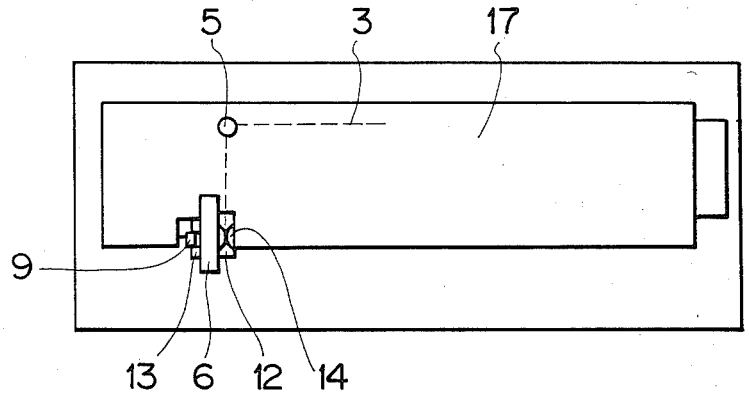
FIG. 9 is a plan view of an automatic thread tension sewing machine.
Figure 10:
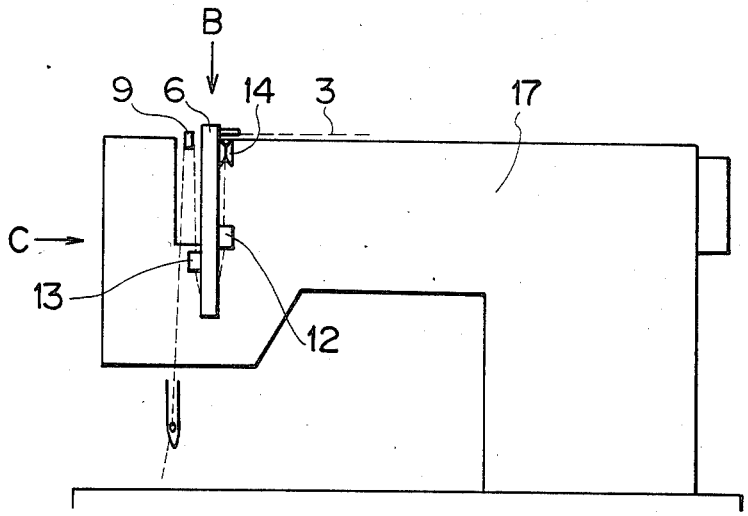
FIG. 10 is a front view of the sewing machine of FIG. 9.
Figure 15:
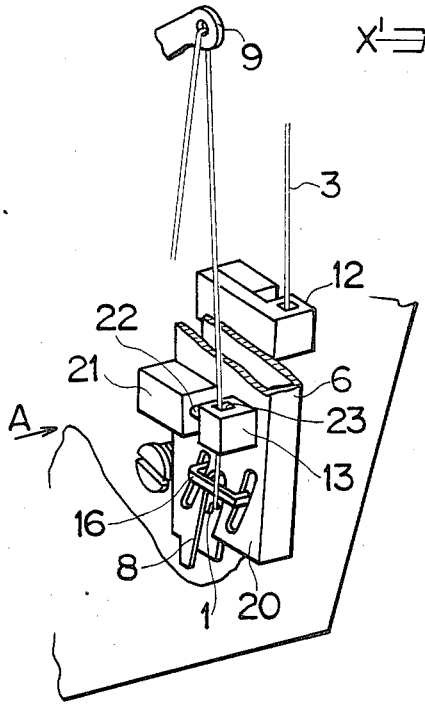
FIG. 15 is a perspective view partially broken showing in greater detail thread tension elements of FIGS. 9 and 10 in accordance with the invention.

FIGS. 9 and 10 are a top view and a front view of the sewing machine 17. The upper thread 3 runs from an upper thread supply (not shown) via the thread guide 5, the pretension 14 and the first stopper 12, and turns at a cutout 8 of a take-up lever cover (FIG. 15) and comes to the take-up lever 9 via the cushion spring 1 (FIG. 15), the thread-drawing out lever 16 (FIG. 15) and the second stopper 13. In FIG. 15, a conventional cushion spring 1 is provided with respect to the cutout 8 of the take-up lever cover 6, and the thread drawing-out lever 16 is exposed to the side 20 of the take-up lever 6. The first stopper 12 and the second stopper 13 are of the same structure, and an explanation will be made in reference to the second stopper 13.

Figure 16:
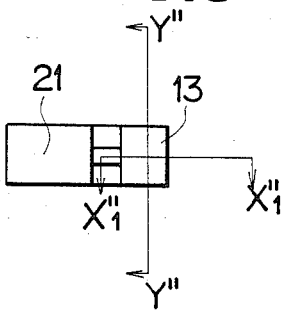
FIG. 16 is a view of an upper thread holding means.
Figure 17:
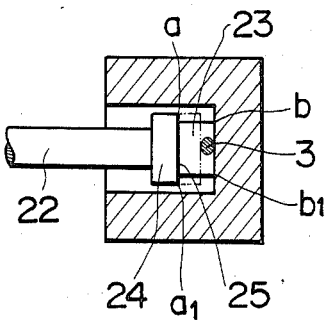
FIGS. 17 and 18 are cross sectional views of the upper thread holding means.
Figure 18:
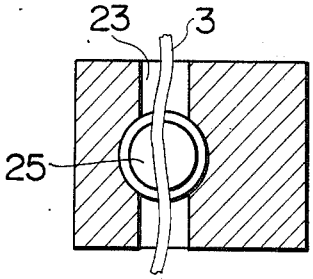

As seen in FIGS. 16 to 18, the stopper 13 holds the upper thread 3 by the pressure of a presser pin 22 axially driven by a magnet portion 21. The stopper is formed with a thread hole 23 of square in cross section for stopping the movement of the thread 3. The end part 24 of the presser pin 22 is formed with a thread presser 25 in disc shape. Since the diameter, a, $a_1$ is larger than the width b, $b_1$ of the thread hole 23, it exactly holds the upper thread 3, when the magnet part 21 is actuated as shown by the dotted line. The magnet part 21 is driven by an electronic circuit (not shown) which is an actuating means housed in the sewing machine.

Figure 19:
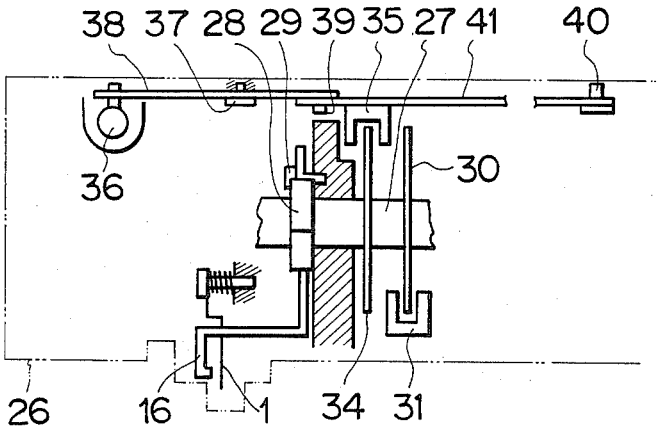
FIGS. 19 and 20 are explanatory views for interior mechanisms of the sewing machine.
Figure 20:
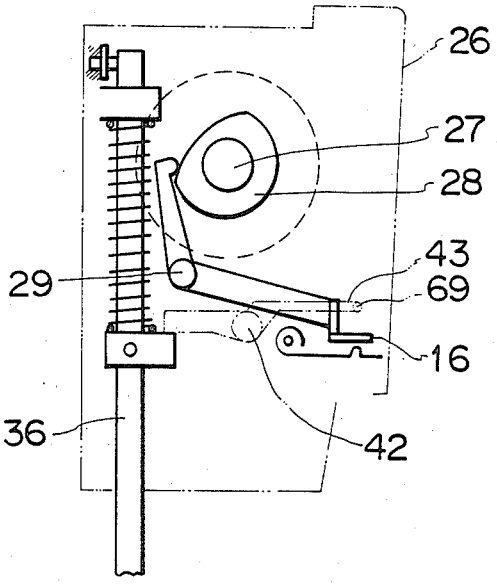

The driving mechanism of the thread drawing-out lever 16 is as shown in FIGS. 19 and 20. FIG. 19 shows an interior of the sewing machine 17 taken along an arrow B of FIG. 10, and the dotted line shows a configuration of the sewing machine 17. FIG. 20 also shows the interior of the sewing machine 17 taken along an arrow C of the same.

The thread drawing-out lever 16 is rotatably pivoted on a pin 29 secured to the machine frame, and normally contacts with its one end to a cam 28 mounted on an upper shaft 27 by means of a spring (not shown), and is exposed at its other end out of the take-up lever side 20 as said above.

The uppermost position in actuation of the thread drawing-out lever 16 is set at an upper side than the uppermost position of the cushion spring 1, while the lowermost position thereof is set at a lower side than the lowermost position of the cushion spring 1.

A phase detector comprises two slits 32, 33 formed in a shielding disc 30 secured on the upper shaft 27, and is to optically detect phases by means of the disc 30 and a light generating part 31 secured to the machine frame. The link 38 is rotatably supported by a pin 37 secured to the machine frame, and is engaged, at its its one end, with a presser bar 36 which is vertically moved with respect to the machine frame, and is engaged, at its other end, with a link 41 rotatably supported by a pin 40 secured to the machine frame. The link 41 is fixed with the photo-interrupter 35.

A further explanation will be made to the forming of stitches in reference to FIG. 25.

The explanation herein will be made but the explanation is omitted with respect to the variation of the reference phase due to the vertical movement of the presser bar.

In FIG. 25, an upper dead point 0° in a lateral axis is a rotation angle $\theta$ of the upper shaft detected by the phase detecting means, and a longitudinal axis shows varying amount of the upper thread and actuations of the respective mechanisms.

$\theta$1 is the upper dead point phase of the take-up lever, where the first stopper 12 holds, as shown to the dotted line in FIG. 17, the upper thread 3 by means of the thread presser 25 at the end part 24 of the presser pin 22 axially driven by the magnet part 21. The second stopper 13 releases the upper thread. Therefore, the upper thread under stitching is tightened by the take-up lever 9.

Figure 21:
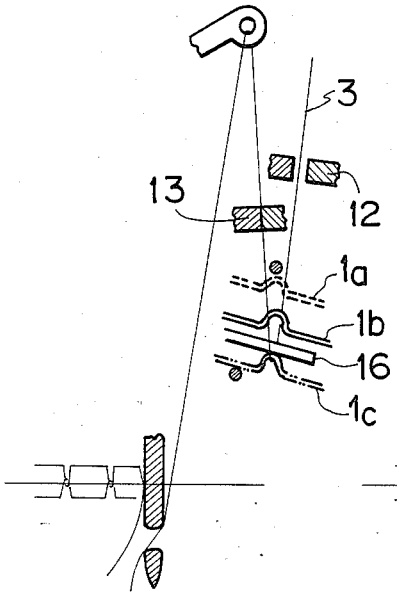
FIGS. 21 and 22 are explanatory views for actuations of a thread supply means.
Figure 22:
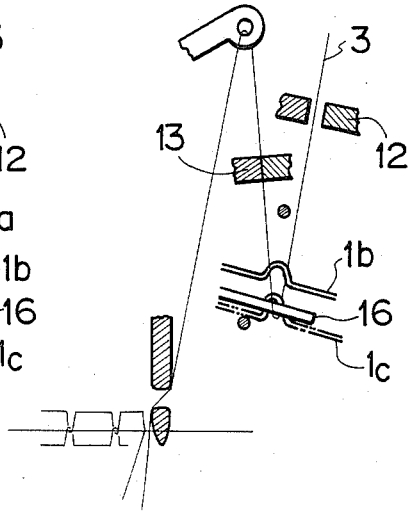

$\theta$2 is a relative phase, where the first stopper 12 still holds the upper thread 3, and since the second stopper 13 holds the upper thread 3, the cushion spring 1 stops at the position 1*b* shown in FIG. 21.

In $\theta$3, the first stopper 12 releases the upper thread 3, and at the same time the thread draw-out lever 16 is driven by the cam 28 mounted on the upper shaft 27 and begins to move down, thereby to supply the upper thread 3 via the pre-tension 14.

Figure 23:
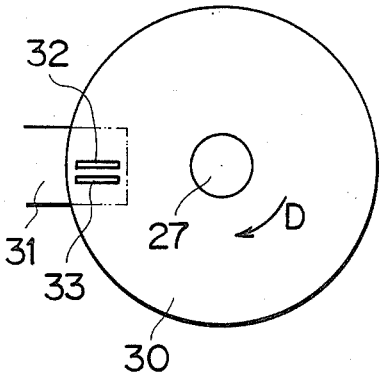
FIGS. 23 and 24 are explanatory views for actuations of a phase detecting means.
Figure 24:
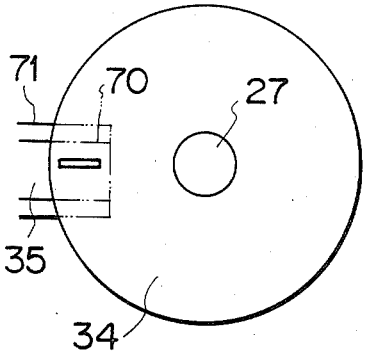

$\theta$4 is a phase for switching in response to the slit 32 shown in FIG. 23, and the thread drawing-out lever 16 is positioned at the reference position 1*c* of the cushion spring 1 in the condition of FIG. 21.

$\theta$5 is a phase for switching in response to the slit 33 shown in FIG. 23. The thread drawing-out lever 16 is lower than the reference position 1*c* of the cushion spring 1 under the condition shown in FIG. 22, and it is possible to supply more upper thread than the standard. In these phases, the first stopper 12 is switched from the releasing condition to the holding condition, and the second stopper 13 is switched from the holding condition to the releasing condition, so that the supply amount of the upper thread 3 by the thread drawing-out lever 16 is supplied to the side of the take-up lever 9.

The switching phase between $\theta$4 and $\theta$5 are selectively made effective in response to the straight stitching and various zigzag stitch patterns where the proper amount of the upper thread is different. The straight stitching is carried out at $\theta$4 by the slit 32 of the disc 30, and the supply amount of the upper thread is at the solid line 45 of FIG. 25. The pattern stitching is carried out at $\theta$5 by the slit 33 of the disc 30, and the supply amount of the upper thread shown by the dotted line 46 is supplied.

The response of the upper thread supply amount to the difference of the fabric thickness depends upon the relative phase shown at θ2. The link 38 connected to the presser bar 36 and the link 41 are rotated by the vertical movement of the presser bar 36, said vertical movement being changed in dependence upon the fabric thickness. The light-generating part 35 is secured on the link 41, and is moved to a position 70 shown by the two-dotted line or a position 71 shown by the three-dotted line with respect to the relative position detecting disc 34, so that the relative phase θ4 is changed to the rotation angle of the upper shaft. In the thick fabric the light generating part 35 is positioned at the two-dotted position 70 by the upward movement of the presser bar. If the phase where the second stopper 13 is actuated, and accelerated by advancing the relative phase θ4, the reference position 1*b* of the cushion spring 1 becomes nearer to the position 1*a* at the upper dead point of the take-up lever, so that the amount of drawing out the upper thread is increased for subsequent increases of the fabric thickness.

In response to the differences of the fabric thickness, the lever 43 which is rotated about a fulcrum of a pin 42, is normally engaged with the presser bar 36 at its one end by means of the spring means (not shown), and is secured as an upper limit stopper 69 at the other end thereof for the upper limit position of the cushion spring 1, so that the upper stroke of the cushion spring 1 is decreased in response to the fabric thickness and the response is possible to the difference of the fabric thickness.

Figure 29:
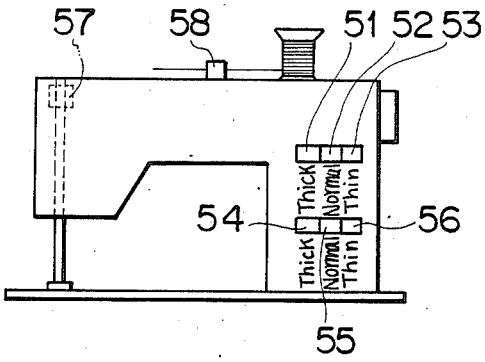
FIG. 29 is a front view of the sewing machine provided with an input means of stitching conditions.

FIG. 29 shows the selecting means of the stitching conditions or the detecting means, that is, a thread thickness selecting means (Thick 51, Normal 52, Thin 53), a fabric thickness selecting means (Thick 54, Normal 55, Thin 56), a fabric thickness detecting means 57 by positioning the presser bar, and a thread thickness detecting means 58. With respect to the information from the input means such as the above mentioned stitching conditions, the switching phases θ4 and θ5 or the relative phase θ2 are altered, thereby to enable to regulate the supply amount of the upper thread.

A second embodiment of the invention will be explained in reference to FIGS. 26 to 29. In this case, a measuring device of the upper thread supplying amount is arranged in the path of the upper thread 3, and in addition, a means for adjusting the upper thread supply amount is provided.

A potentiometer 47 is provided in a thread path of the upper thread on an upper part 4 of the sewing machine between thread guides 5 and 48, so as to measure a supplied amount of the upper thread. There is provided a calculation circuit (not shown) including a selection or detection means (51 through 58) and a memory means as shown in FIG. 29.

Figure 28:
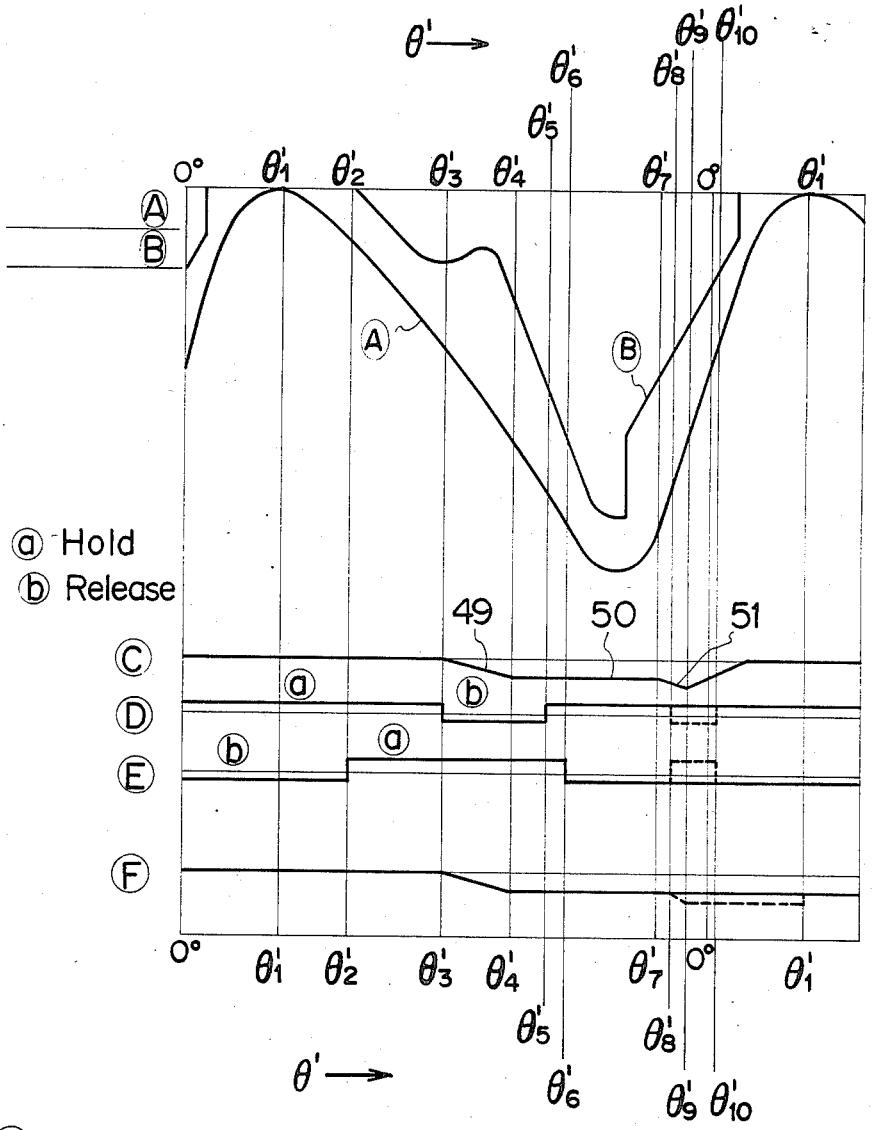
FIG. 28 is a graphical view illustrating the actuation status in each of the phases of various elements of the automatic thread tension sewing machine.
Figure 30:
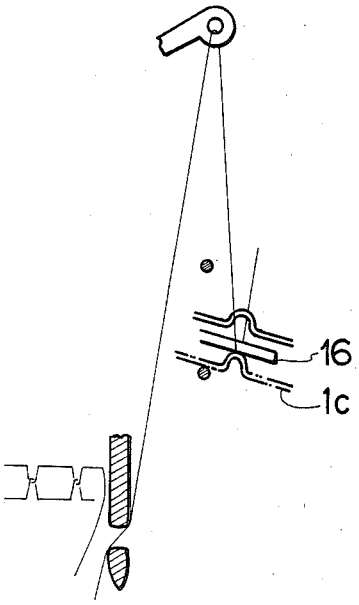
FIGS. 30 and 31 are explanatory views for actuations of an upper thread drawing-out means.
Figure 31:
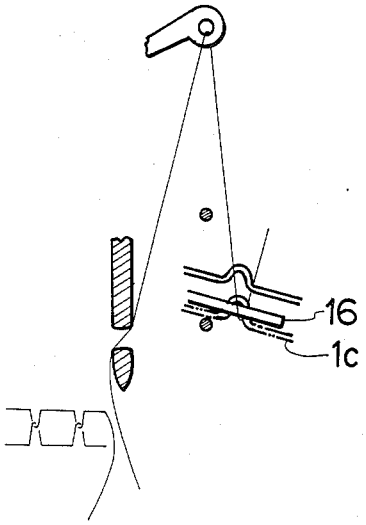

The thread drawing-out lever 16 is driven by the cam 28 (FIG. 20), in a first falling phase 49 (θ'3 to θ'4) as shown in FIG. 28, in a phase 50 (θ4 to θ9) maintaining the lowest level of the first phase, and in a second phase 51 (θ'7 to θ'9) performing a second falling. The phase 50 pushes up the thread drawing-out lever 16 above the reference position 1*c* of the cushion spring as shown in FIG. 30. The phase 51 pushes down the thread drawing-out lever 16 below the reference position 1*c* of the cushion spring as shown in FIG. 31.

A next reference will be made to the forming of the stitches with FIG. 28. θ'1 shows an upper dead point of the take-up lever, where the first stopper 12 holds the upper thread, while the second stopper 13 releases it. Therefore, the upper thread of the stitches is tightened by the take-up lever 9, and the cushion spring 1 is at the uppermost position 1*a* shown in FIG. 21. θ2 is the relative phase, where the first stopper 12 still holds the upper thread 3, and so the cushion spring 1 stops at the position 1*b* in FIG. 21. In θ'3, the first stopper 12 releases the upper thread 3, and at the same time the thread drawing-out lever 16 is driven by the cam 28 secured to the upper shaft 27, and moves down until the phase θ'4, and the upper thread 3 is supplied via the thread guide 5, the potentiometer 47, and thread guide 48. This supply amount is measured by the potentiometer 47. This measuring result is compared with, the input information from the selection means or detecting means of the stitching conditions, so that an amending amount is calculated for the proper consumption of the upper thread in the above mentioned stitching conditions, so as to release the first stopper 12 at the second falling phase 51 (θ7 to θ8) and control a phase actuating the second stopper 13 for supplying the proper consumption amount of the upper thread required for the above mentioned stitching conditions. The thread drawing-out lever 16 is moved lower than the reference position 1*c* of the cushion spring as shown in FIG. 31, so that the surplus supply of the upper thread may be carried out.

Figure 32:
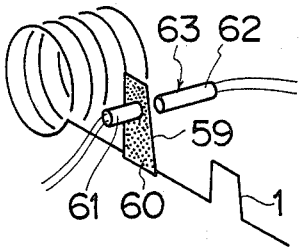
FIG. 32 is an explanatory view for a structure of a detecting means of a cushion spring.
Figure 33:
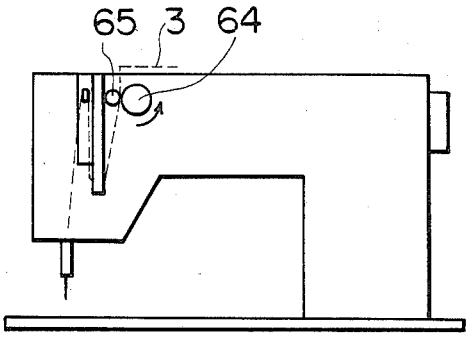
FIG. 33 is a front view of a sewing machine having a third embodiment in which light sensors detect relative phase positions of the invention.
Figure 34:
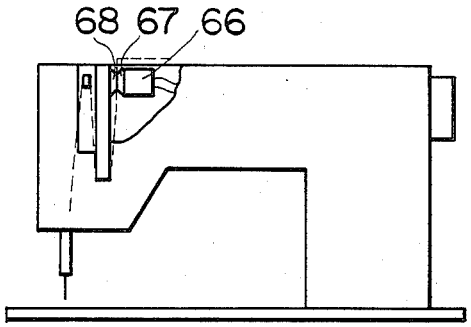
FIG. 34 is a front view partially broken to show upper thread tension pressure elements suitable with the above mentioned sewing machine of the third embodiment.

A still further explanation will be made to a third embodiment with FIGS. 32 to 34. In the sewing machine shown in FIG. 33, in addition to the phase detecting means and the cushion spring 1 of the first embodiment, the cushion spring 1 shown in FIG. 32 is provided with an actuating position detecting means, a counting means, a pulley 64 connected to a stepping motor (not shown), and a supply means by a follower pulley 65. The actuating position detecting means 63 of the cushion spring and as such 1 is provided with a thin flag 60 of hard property of obliquity in cross section.

The flag 60 detects the actuating position of the cushion spring 1 by changing the amount of light projection from a diode element 61 to a light receiving element 62 in view of the actuating position of the cushion spring. The relative phase is counted such that the stepping motor is actuated to have the proper thread tension.

The proper thread tension may be provided by controlling the pressure of an upper thread tension device which presses a pair of thread tension discs 67, 68 by means of an electro-magnetic device 66.

The above embodiment counts out the surplus amount of the upper thread by the actuating position of the cushion spring, but the surplus amount of the upper thread may be counted out in dependence upon the phase measuring result at a certain position of the cushion spring.

According to the present invention, as mentioned above, it is possible to supply the upper thread corresponding to the proper consumption amount of the upper thread in response to each of the stitching conditions without employing the practical difficulty such as the detection of the proper upper thread amount or the crossing position of the stitches.

What is claimed is:

1. An automatic thread tension adjusting device on a sewing machine that includes an upper drive shaft rotatable to vertically reciprocate a swingable needle to penetrate a fabric to be sewn and also to reciprocate a thread take-up lever to supply an upper thread from a supply means to the needle and tighten a stitch to be formed and includes a loop taker rotatable in association with the upper drive shaft to catch the upper thread for interlocking the upper thread with a lower thread to form the stitch, the upper thread being extended between an upper thread supply and the needle and through at least the thread takeup lever, said automatic thread tension adjusting device comprising:

(a) thread tension means (14) provided between said upper thread supply and said thread take-up lever, said thread tension means guiding said upper thread and normally giving a predetermined constant tension to said upper thread;

(b) cushion spring means (1) provided between said thread tension means and said thread take-up lever, said cushion spring means absorbing a surplus of thread between said thread tension means and said thread take-up lever, said surplus thread resulting from the difference between an upper thread amount required by said loop taker and an upper thread amount supplied by said thread take-up lever, said cushion spring means having an elastic force greater than the tension of said thread tension means (14) and movable in a predetermined range to absorb said surplus upper thread;

(c) first means (12) provided between said thread tension means and said cushion spring and being activable to hold said upper thread between said thread tension means and said cushion spring means;

(d) second means (13) provided between said cushion spring means and said thread take-up lever and being activable to hold said upper thread between said cushion spring means and said thread take-up lever;

(e) first sensor means (34), (35) operable in association with the rotation of said upper drive shaft for giving a first signal at a first angular position $\theta_2$ of said upper drive shaft while said first thread holding means (12) is activable to hold said upper thread, said first signal activating said second thread holding means (13) to hold said upper thread; and (f) second sensor means (30, 31) operable in association with the rotation of said upper drive shaft to give a second signal at a second angular position $\theta_3$ of said upper drive shaft, said second signal inactivating said first thread holding means (12) to release said upper thread, said second sensor means producing a third signal at a third angular position $\theta_4$ of said upper drive shaft, said third signal activating said first thread holding means (12) to hold said upper thread and simultaneously inactivating said second thread holding means (13) to release said upper thread, such that said surplus upper thread is supplied to said fabric to be sewn.

2. A device as defined in claim 1, wherein the needle has a needle eye with an upper end, the fabric having a center of thickness, the needle having a descending movement, said upper end of said needle eye being at the center of thickness of the fabric during the descending movement of the needle when said upper drive shaft is at said first angular position $\theta_2$.

3. A device as defined in claim 1; further comprising a fabric presser bar axially reciprocable depending upon the thickness of the fabric to be sewn and a link (41) operatively connectable to said presser bar and movable in association with the axial reciprocation of the fabric presser bar, said first sensor means (34, 35) including a photo-coupler (35) secured to said link and a photo-interupting disk (34) secured to the upper drive shaft for rotation therewith.

4. A device as defined in claim 1, wherein said thread draw-out means (16) includes a control cam (28) secured to said upper drive shaft (27) for rotation therewith and a lever pivotally mounted on the sewing machine and having one end engagable with said control cam and the other end disposed between said cushion spring means (1) and said second thread holding means.

5. An automatic thread tension adjusting device on a sewing machine that includes an upper drive shaft rotatable to vertically reciprocate a swingable needle to penetrate a fabric to be sewn so that the needle has a descending movement, and also to reciprocate a thread take-up lever to supply an upper thread to the needle and to tighten a stitch to be formed and includes a loop taker rotatable in association with the upper drive shaft to catch the upper thread for interlocking the upper thread with a lower thread to form the stitch, the upper thread being extended between an upper thread supply and the needle and through at least the thread take-up lever, the needle having a needle eye, the fabric having a thickness, said automatic thread tension adjusting device comprising:

(a) thread tension means (14) provided between said upper thread supply and said thread take-up lever, said thread tension means guiding said upper thread and normally giving a predetermined constant tension to said upper thread;

(b) cushion spring means (1) provided between said thread tension means and said thread take-up lever, said cushion spring means absorbing a surplus of thread between said thread tension means and said thread take-up lever, said surplus thread resulting from the difference between an upper thread amount required by said loop taker and an upper thread amount supplied by said thread take-up lever, said cushion spring means having an elastic force greater than the tension of said thread tension means and being movable in a predetermined range to absorb said surplus upper thread;

(c) first sensor means (34, 35), operable in association with the rotation of said upper drive shaft to give a first signal at a first angular position $\theta_2$ of said upper drive shaft, at which said needle eye is in the thickness of said fabric during the descending movement of said needle while said first thread holding means (12) is activable to hold said upper thread, said first signal activating said second thread holding means (13) to hold said upper thread; and (d) second sensor means (30, 31) operable in association with the rotation of said upper drive shaft to give a second signal at a second angular position $\theta_3$ of said upper drive shaft, said second signal inactivating said first thread holding means (12) to release said upper thread, said second sensor means producing a third signal at a third angular position $\theta_4$ of said upper shaft, said third signal activating said first thread holding means (12) to hold said upper thread and simultaneously inactivating said second thread holding means (13) to release said upper thread, such that said surplus upper thread is supplied to said fabric to be sewn.

6. An automatic thread tension adjusting device on a sewing machine that includes an upper drive shaft rotated to vertically reciprocate a swingable needle to penetrate a fabric to be sewn and also to reciprocate a thread take-up lever to supply an upper thread to the needle and tighten a stitch to be formed and includes a loop taker rotatable in association with the upper drive shaft to catch the upper thread for interlocking the upper thread with a lower thread to form the stitch, the upper thread being extended between an upper thread supply and the needle and through at least the thread takeup lever, said automatic thread tension adjusting device comprising;

(a) thread tension means (14) provided between said upper thread supply and said thread take-up lever, said thread tension means guiding said upper thread and normally giving a predetermined constant tension to said upper thread;

(b) cushion spring means (1) provided between said thread tension means and said thread take-up lever, said cushion spring means absorbing a surplus of thread between said thread tension means and said thread take-up lever, said surplus thread resulting from the difference between an upper thread amount required by said loop taker and an upper thread amount supplied by said thread take-up lever, said cushion spring means having an elastic force not greater than the tension of said thread tension means (14) and movable in a predetermined range to absorb said surplus upper thread;

(c) first means (12) provided between said thread tension means and said cushion spring means and being activable to hold said upper thread between said thread tension means and said cushion spring means;

(d) second means (13) provided between said cushion spring means and said thread take-up lever and being activable to hold said upper thread between said cushion spring means and said thread take-up lever;

(e) thread draw-out means (16) provided between said cushion spring means and said second thread holding means, said thread draw-out means operable in association with the rotation of said upper drive shaft to draw out said surplus upper thread between said cushion spring means and said second thread holding means in a predetermined range ($\theta_3$–$\theta_5$) of the angular positions of said upper drive shaft;

(f) first sensor means (34, 35) operable in association with the rotation of said upper drive shaft for giving a first signal at a first angular position $\theta_2$ of said upper drive shaft while said first thread holding means (12) is activable to hold said upper thread, said first signal activating said second thread holding means (13) to hold said upper thread; and (g) second sensor means (30, 31) operable in association with the rotation of said upper drive shaft to give a second signal at a second angular position $\theta_3$ of said upper drive shaft, at which said thread draw-out means (16) starts to draw out said surplus upper thread, said second signal inactivating said first thread holding means (12) to release said upper thread, said second sensor means producing a third signal at a third angular position $\theta_4$ of said upper drive shaft, said third signal activating said first thread holding means (12) to hold said upper thread and simultaneously inactivating said second thread holding means (13) to release said upper thread, such that said surplus upper thread is supplied to said fabric to be sewn.

7. The device as defined in claim 6, wherein the needle has a needle eye and an ascending movement, the fabric having a thickness, the needle being in the thickness of said fabric during the ascending movement of said needle when said upper drive shaft is at said first angular position $\theta_2$.

8. An automatic thread tension adjusting device on a sewing machine that includes includes an upper drive shaft rotatable to vertically reciprocate a swingable needle to penetrate a fabric to be sewn such that the needle has a descending movement and also to reciprocate a thread take-up lever to supply an upper thread to the needle and tighten a stitch to be formed and includes a loop taker rotated in association with the upper drive shaft to catch the upper thread for interlocking the upper thread with a lower thread to form the stitch, the upper thread being extended between an upper thread supply and the needle and through at least the thread take-up lever, the needle having a needle eye with an upper end, the fabric having a center of thickness, said automatic thread tension adjusting device comprising:

(a) thread tension means (14) provided between said upper thread supply and said thread take-up lever, said thread tension means guiding said upper thread and normally giving a predetermined constant tension to said upper thread;

(b) cushion spring means (1) provided between said thread tension means and said thread take-up lever, said cushion spring means absorbing a surplus of thread between said thread tension means and said thread take up lever, said surplus thread resulting from the difference between an upper thread amount required by said loop taker and an upper thread amount supplied by said thread take-up lever, said cushion spring means having an elastic force not greater than the tension of said thread tension means (14) and movable in a predetermined range to absorb said surplus upper thread;

(c) first means (12) provided between said thread tension means and said cushion spring and activable to hold said upper thread between said thread tension means and said cushion spring means;

(d) second means (13) provided between said cushion spring means and said thread take-up lever and activable to hold said upper thread between said cushion spring means and said thread take-up lever;

(e) thread draw-out means (16) provided between said cushion spring means and said second thread holding means, said thread draw-out means operable in association with the rotation of said upper drive shaft to draw out said upper thread from said upper thread supply in a predetermined range ($\theta_3$–$\theta_5$) of the angular positions of said upper drive shaft;

(f) first sensor means (34, 35) operable in association with the rotation of said upper drive shaft for giving a first signal at a first angular position $\theta_2$ of said upper drive shaft, at which said upper end of said needle eye is at the center of thickness of said fabric during the descending movement of said needle while said first thread holding means (12) is activable to hold said upper thread, said first signal activating said second thread holding means (13) to hold said upper thread; and (g) second sensor means (30, 31) operable in association with the rotation of said upper drive shaft to give a second signal at a second angular position $\theta_3$ of said upper drive shaft, at which said thread draw-out means (16) starts to draw out said upper thread, said second signal inactivating said first thread holding means (12) to release said upper thread, said second sensor means producing a third signal at a third angular position $\theta_4$ of said upper drive shaft, said third signal activating said first thread holding means (12) to hold said upper thread and simultaneously inactivating said second thread holding means (13) to release said upper thread, such that said surplus upper thread is supplied to said fabric to be sewn.

* * * * *